United States Patent [19]

Umlauf

[11] Patent Number: 5,069,427

[45] Date of Patent: Dec. 3, 1991

[54] STAND FOR EXERTING A FORWARD OR REARWARD DRAG ON STRIPS

[76] Inventor: Norbert Umlauf, Haferkamp 64, 5800 Hagen 1, Fed. Rep. of Germany

[21] Appl. No.: 525,075

[22] Filed: May 17, 1990

[30] Foreign Application Priority Data

May 19, 1989 [DE] Fed. Rep. of Germany ..... 3916289

[51] Int. Cl.[5] ..... C21D 9/60; H05B 3/00

[52] U.S. Cl. ..... 266/104; 148/130

[58] Field of Search ..... 266/104; 148/130

[56] References Cited

U.S. PATENT DOCUMENTS

| | | | |
|---|---|---|---|
| 2,806,130 | 9/1957 | Gray | 266/104 |
| 2,894,115 | 7/1959 | Alf | 266/104 |
| 3,353,806 | 11/1967 | Lichte | 266/104 |
| 3,792,684 | 2/1974 | Janatka et al. | 266/104 |
| 4,085,922 | 4/1978 | Moreau | 266/104 |
| 4,116,422 | 9/1978 | Vogel et al. | 266/104 |
| 4,372,539 | 2/1983 | Starnes | 266/104 |
| 4,525,175 | 7/1985 | Kyriakis | 266/104 |

*Primary Examiner*—Upendra Roy

*Attorney, Agent, or Firm*—Toren, McGeady & Associates

[57] ABSTRACT

A stand for exerting a forward or rearward drag upon metal strips or sheets, in particular for a plurality of narrow strips which are to be wound up together with separate braking drags being applied to each strip, between two oppositely disposed, endlessly circulating conveyor chain systems driven by chain wheels, wherein a belt arranged between at least one chain system and the metal strip prevents particles of dirt such as forging scale, zinc and tin fines, etc. from entering the chain case.

15 Claims, 2 Drawing Sheets

STAND FOR EXERTING A FORWARD OR REARWARD DRAG ON STRIPS

TECHNICAL FIELD OF THE INVENTION

The invention relates to a stand for exerting forward or rearward drag on metal strips or sheets, in particular for use with a plurality of narrow strips which are to be wound up together with separate braking drags being applied to each strip, between two oppositely disposed, endlessly circulating conveyor chain systems driven by chain wheels.

BACKGROUND OF THE INVENTION AND PRIOR ART

A braking stand of this kind for metal or sheet metal strips is known from EP-PS 195 096. With this stand, whose chain systems clamp the strip or sheet with carriage-like roller units guided on rails in a straight drag-applying or entraining zone, the large pulling or restraining force (up to 200 t) required when holding back or pulling forward metal strips can be applied without harmful effects to the surface of the strip, which may or may not be divided into narrower strips. This is achieved primarily by controlled feeding of the chain systems with the roller units into a relatively short clamping and entraining zone by means of straight guide rails which simultaneously provide resistance to the large clamping forces. This enables the relatively large clamping forces which are necessary to provide large pulling or restraining forces to be accepted without relative movement between the strip and the circulating, carriage-like roller units. Guiding each chain along a path that is curved except in the entraining zone assists the controlled feeding of the roller units. Thus the chains, which are composed of a plurality of roller units directly coupled together, can move to the greatest possible extent without sudden changes in direction, so that on the one hand the controlled parallel feeding of the opposed roller units of the chain systems into the entraining zone is promoted and on the other hand very high speeds—for example up to 1,000 m/min.—are possible.

With a braking stand of this kind, which enables large pulling or holding forces to be applied without damaging the surface, even strips having very sensitive surfaces, e.g. aluminium strips, can be handled using the desired large pulling or holding forces. It has however been found that, since a closed surface of the roller units only exists in the straight entraining zone, materials such as scale (e.g. if the braking stand is arranged after a furnace), sometimes unavoidable zinc and tin fines, etc. find their way into the chain case through the gaps between neighbouring roller units. Once such pieces, or dirt particles, have entered the chain case, which is located inside the circulating chains, they can accumulate there on the rails, gear wheels and bearings and lead to breakdowns.

OBJECT OF THE INVENTION

An object of the invention is to avoid the aforementioned disadvantages and to prevent particles of dirt from reaching the chain case.

THE INVENTION

To this end, according to the invention a belt is arranged between at least one chain system and the metal strip. Such belts shielding the chain systems inwardly in the straight entraining zone could, e.g., be unwound from take-off reels at the strip inlet end of the stand and wound on to winding reels arranged at the outlet end of the stand. In the entraining zone the belt or belts is or are carried along by the circulating chain systems.

According to a preferred embodiment of the invention the belt comprises an endless belt surrounding the chain system radially. The chain systems, preferably two in number and each surrounded radially by an endless belt, are thus protected by a closed surface so that scale such as that from heavily scaled hot-rolled strip, zinc and tin fines and other dirt particles can no longer enter the chain case; breakdowns caused by dirt can thus very largely be avoided. Furthermore the closed surface of the endless belts allows the belts to be cleaned at the inlet or outlet end of the entraining zone by means of steam jets, which is an additional advantage particularly when handling strips having very sensitive surfaces. Finally, it is important, in particular for strips having sensitive surfaces, that the endless belts provide a closed, even contact surface with the metal strip, which avoids crushing and the need for milling work. As with the known stand, in the case of the shielded or enveloped chain systems according to the invention the forces can be applied by means of a linear motor instead of by a rotary motor (e.g. direct current motor). Furthermore it is possible to control the metal strip or slit strips by arranging the stand on a control frame. Thus the metal strip can be displaced, and controlled varied strip tensioning over the width of the metal strip can be achieved. This control effect can be used to influence the rolling process and to displace the metal strip in the roll gap of the roll of a rolling mill stand. By using the holding back and pulling forward stand together with a stetching-bending-straightening device the control effect can be used as an additional correcting variable when stretcher levelling. For example, the bending rollers of the stretching-bending-straightening device can likewise be steerable like a control roller.

The belts or endless belts are not driven, but are carried along by the circulating chain systems in the entraining or tensioning zone of the stand. The carrying along of the endless belts is ensured by contact with the coated carriage-like roller units. The forces acting on the endless belts, arising from the tensioning forces of the chain systems, the belt pretensioning forces and possible lateral forces from the strip control are transmitted reliably. This can be promoted by the choice of suitable pairs of materials for the contact surfaces such as the materials of the coating of the roller units and of the endless belt, e.g. rubber on rubber. The specific loadings of the belt can be kept very low. The criteria for the belt material are the same as those for the coating of the surfaces of the carriage-like roller units; for example polyurethane or rubber are suitable. If large forces are to be applied a correspondingly harder material is required, while in the case of small forces a correspondingly softer material can be used. Depending on the use of the stand, it may be possible to dispense completely with an elastic coating on the roller units.

It is desirable to guide the endless belts over deflecting pulleys, and advantageously at least one of the deflecting pulleys can be formed as a tension pulley. The deflecting pulleys promote the gentle pulling of the endless belts on from the side; the belts can be pushed on the deflecting pulleys like loops. By means of the tension pulley—a tension pulley can alternatively be arranged to dip into the run of the endless belt—the endless belt to be pushed on or taken off can be brought to the state of tension necessary for operation or to an untensioned state to simplify removal. Because exchange is so simple the braking stand can readily be adapted to carry out special operations, for example, if the same stand has to be used to treat oiled strip instead of the dry strip previously treated.

The deflecting pulleys arranged at the inlet and outlet ends of the entraining zone are suitably cylindrical. The guidance of the endless belt directly before and after the entraining zone by means of cylindrical pulleys helps to avoid the formation of folds in this zone, in which the strip is clamped without relative movement and with extraordinarily large forces.

If, as is advantageous, the deflecting pulleys remote from, i.e. disposed radially outside, the entraining zone are advantageously barrelled, automatic centering of the circulating endless belt can be achieved. At the same time at least one of these pulleys can be operated as a control pulley; it can, for example, be adjusted manually by way of a pivot and in this way can also influence the course of the endless belts.

Providing the belts with a profile increases their elasticity, which is particularly advantageous when holding back or pulling forward slit strips. In addition, the profiles counteract or prevent the aquaplaning effect which often unavoidably occurs in wet processes. A stand having chain systems enveloped by endless belts can also be used as a squeegee or wringer unit and can, for example, perform the functions of a drive, control and squeegee unit in a pickling system. The aforementioned effects or advantages can also be achieved if the sides of the belts facing the metal strip are provided with an elastic, preferably profiled, coating. For example, by using a coating of polyurethane or rubber, e.g. about 30 mm thick, together with profiling it is possible to obtain controlled elastic behaviour, in particular when treating slit strips. When pulling forward or holding back hot strips (for example at a temperature of 300° C.) this has a remarkably favourable effect as, after contact with the metal strip in the entraining zone, the endless belts can immediately be cooled intensively from both sides so that the high temperature of the belts can be reduced effectively and in a relatively short time.

The belt can consist of a heat-resistant, heat-conducting or noise-damping material or of a combination thereof (and other materials). The nature and properties of the belt, which is preferably made up of several layers of material, can be varied as desired, depending on the operational conditions and the use to which it is put, by the appropriate selection of materials. Belts suitable for use with hot metal strips can be made of asbestos-like, heat-resistant material, and a metal strip at high temperature, e.g. up to 350° C., can be pulled forward or held back by this means alone.

Depending on the structure and composition of the belt, which may be multi-layered and consist, for example, of metal, metal alloys, woven fabric, polyurethane or rubber, cooling of the metal strip by a fall in temperature between the metal strip and the belt can be achieved; controlled cooling of the metal strip is thus possible. The removal of heat from the strip depends on the thermal conductivity of the belt material; if for instance it consists of a copper alloy, metal strips having temperatures of up to, for example, 700° C. can be influenced metallurgically. Thus by cooling a very hot metal strip at a very fast cooling rate specific microstructures can be obtained. The stand according to the invention for pulling forward or holding back metal strips thus makes it possible both to produce strip tension and at the same time to exert control effects and to exert a metallurgical influence on the microstructure of the metal strip.

To supply electric current to the metal strip treated in the stand according to the invention in electrolytic processes, or so as to heat the metal strip quickly from room temperature to a desired temperature in the belts can be formed so as to carry electric current. If, for example, the belts have an outer coating of copper it is possible to transfer relatively large amounts of heat to the metal strip in the entraining zone of the stand in a very short time; this is assisted by the fact that, since the metal strip is held on two sides, large contact surfaces and thus large cross-sections and large contact forces are available. In the case of belts which have a rubber layer the necessary insulation is obtained simultaneously without additional means.

The reduction in noise already achieved by enveloping or at least shielding the chain systems can be further improved if the belts consist of a noise-damping material, e.g. of rubber or rubber combined with a carrier layer of woven fabric.

BRIEF DESCRIPTION OF THE DRAWINGS

The invention will now be described in more detail with reference to a preferred exemplary embodiment according to the invention in which both chain systems of a stand are enveloped radially by endless belts, and illustrated in the drawings in which.

DETAILED DESCRIPTION OF A PREFERRED EMBODIMENT OF THE INVENTION

Figure 2:
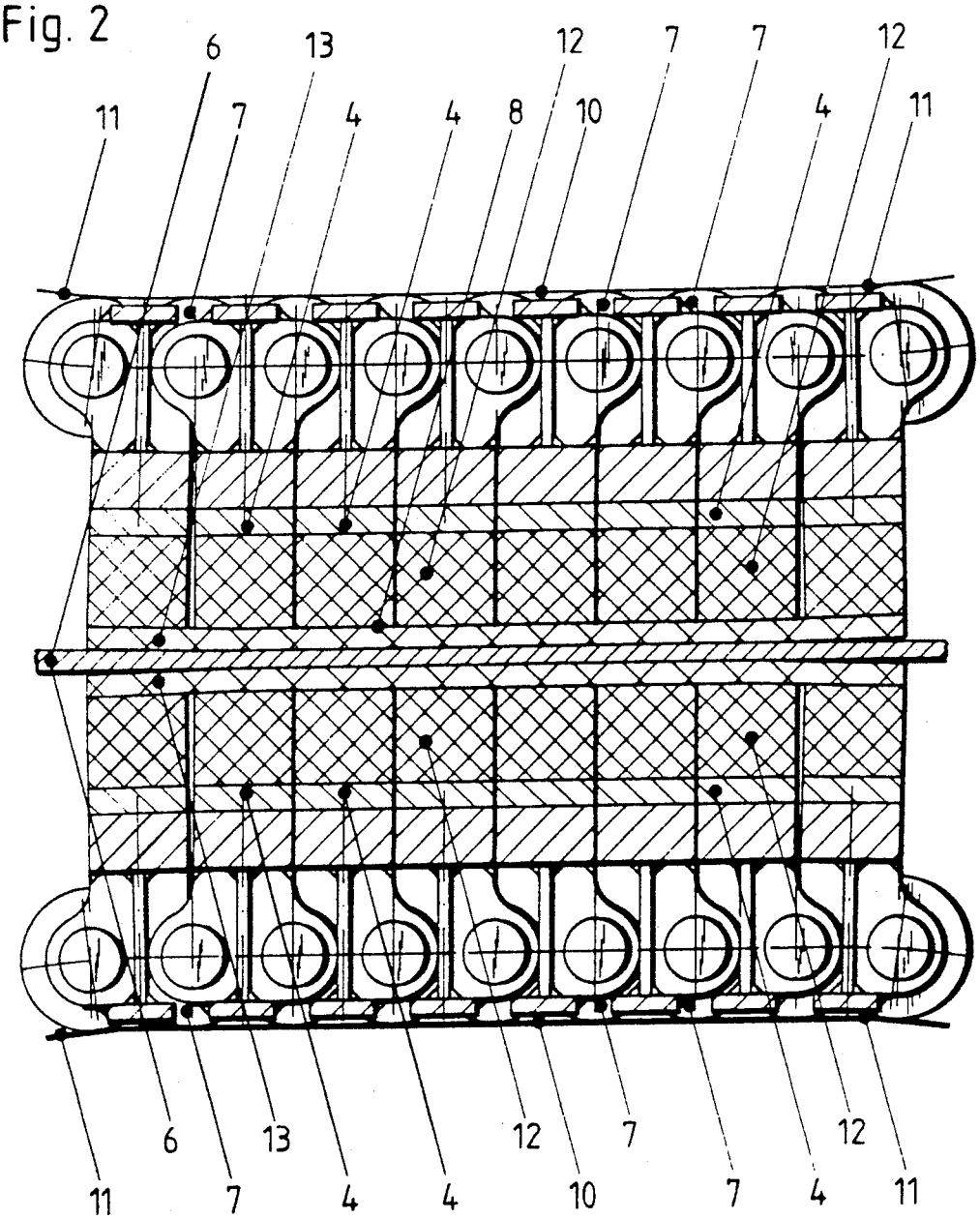
FIG. 2 shows, as a detail, oppositely disposed roller units in the entraining zone of the braking stand.

The braking and holding back stand 1 comprises two oppositely disposed chain systems 2, 3 of which the upper chain system 2 can be positioned against the lower chain system 3. The chains 2, 3 are composed of a plurality of coupled, carriage-like roller units 4, which extend across the entire width of a metal strip 6 which enters in the direction of the arrow 5, and are supported by wheels 7, at least on both sides, on the guide track 9 which is arcuate except for the straight entraining zone 8. In the entraining zone 8, in which the oppositely arranged roller units 4 encompass the strip 6 on both sides and clamp it between them (cf. FIG. 2) the guide track 9 comprises straight guide rails 10 having inclined surfaces 11 at the inlet and outlet sides. The upper or entraining surfaces of the roller units 4 are provided with an elastic coating 12; they are of a width corresponding to the chain pitch and extend within the pivot axes defined by axles of the support wheels 7 of two adjacent, i.e. successive, units 4 (cf. FIG. 2).

Figure 1:
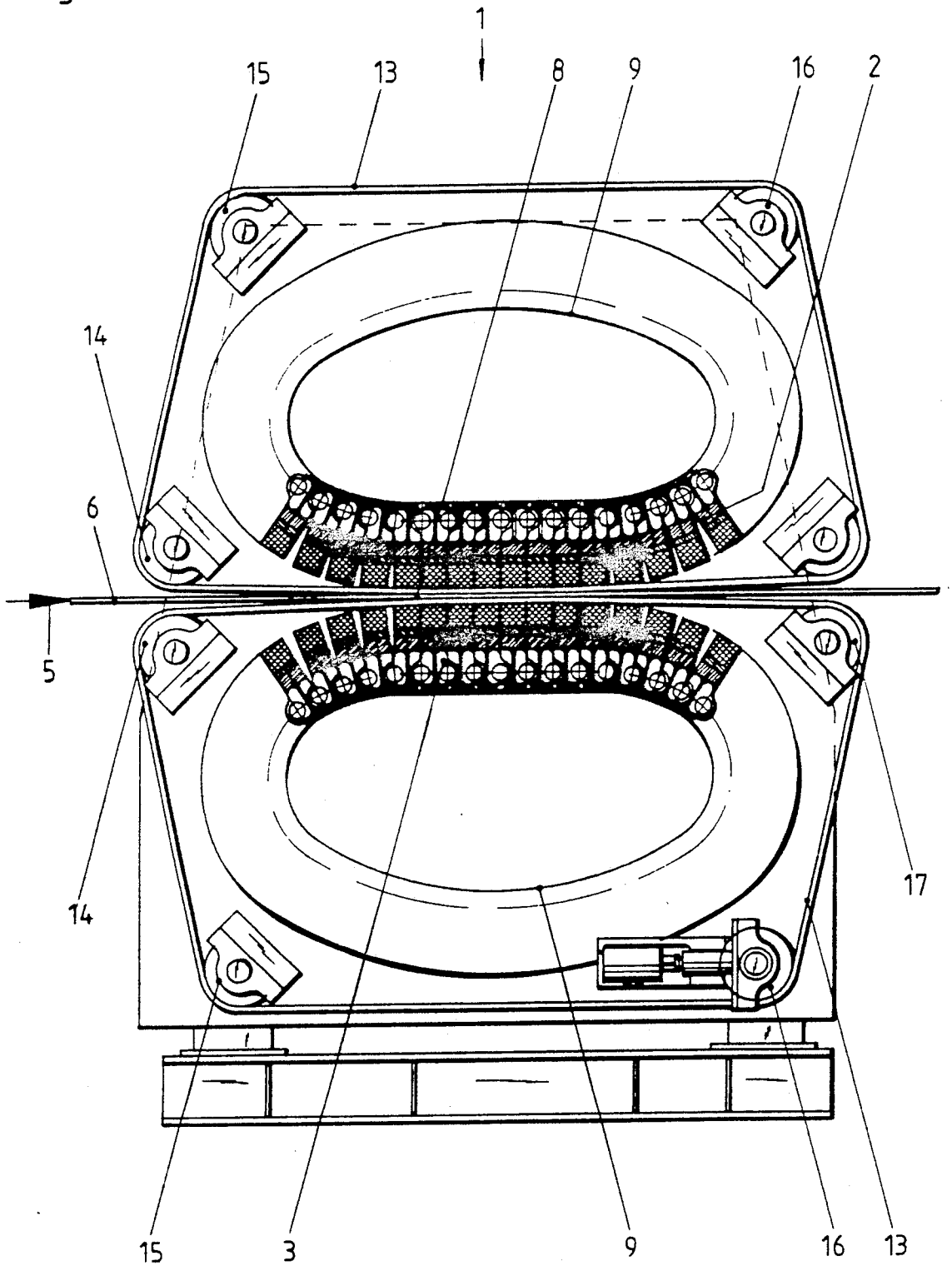
FIG. 1 shows diagrammatically, in side elevation, a braking stand having two oppositely disposed chain systems enveloped radially by endless belts.

As shown in FIG. 1, each chain system 2, 3 is enveloped radially by an endless belt 13. The endless belts 13 are guided by means of deflecting pulleys 14, 15, 16 and 17, of which the deflecting pulleys 14 and 17 arranged at the inlet and outlet ends of the entraining zone 8 are cylindrical. On the other hand the deflecting pulleys 15, 16 remote from, i.e. each disposed radially outside the entraining zone 8, are barrelled, which assists the centering and/or adjustment of the guidance of the endless belts 13.

Figure 3:
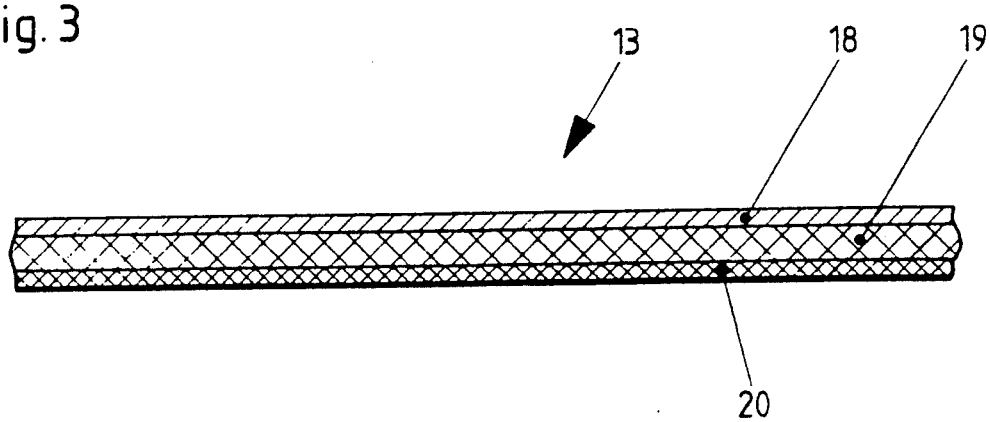
FIG. 3 shows the cross-section of an endless belt comprising several layers of material.

The endless belt 13 shown in cross-section in FIG. 3 is structured like a sandwich; it comprises three layers of material 18, 19, 20, namely a carrier layer 19 of woven fabric, an inner layer 18 of metal which is in contact with the metal strip 6 (cf. FIG. 2, the lower endless belt) and an elastic outer layer 20 of rubber or polyurethane. This structure, however, merely illustrates one possible selection of any desired layers of material for a sandwich-like endless belt, that can be varied according to the use to which it is to be put.

What is claimed is:

1. A stand for exerting a forward or backward drag upon metal strips or sheets, in particular for a plurality of narrow strips which are to be wound up together with separate braking drags being applied to each strip, between two oppositely disposed, endlessly circulating conveyor chain systems driven by chain wheels, wherein a belt is arranged between at least one of said chain systems and the metal strip.

2. A stand according to claim 1, wherein said belt is an endless belt enveloping said chain system radially.

3. A stand according to claim 1, wherein said belt is profiled.

4. A stand according to claim 1, wherein the side of said belt facing said metal strip is provided with a layer of elastic material.

5. A stand according to claim 1, wherein the side of said belt facing said metal strip is provided with a layer of metallic material.

6. A stand according to claim 1, wherein said belt is heat-resistant.

7. A stand according to claim 1, wherein said belt consists of heat-conductive material.

8. A stand according to claim 1, wherein said belt comprises several layers of material.

9. A stand according to claim 1, wherein said belt consists of noise-damping material.

10. A stand according to claim 1, wherein said belt is such as to transmit electric current to said metal strip.

11. A stand according to claim 2, wherein said endless belt is deflected by pulleys.

12. A stand according to claim 2, wherein at least one of said pulleys is a tension pulley.

13. A stand according to claim 2, wherein the deflecting pulleys arranged at the inlet and outlet sides of the entraining zone are cylindrical.

14. A stand according to claim 2, wherein the deflecting pulleys remote from said entraining zone are barrelled.

15. A stand according to claim 4, wherein said layer of elastic material is profiled.

* * * * *